US009608339B2

(12) United States Patent
Ito

(10) Patent No.: US 9,608,339 B2
(45) Date of Patent: Mar. 28, 2017

(54) CRIMPED TERMINAL ATTACHED ALUMINUM ELECTRIC WIRE

(71) Applicant: Yazaki Corporation, Minato-ku, Tokyo (JP)

(72) Inventor: Yuichi Ito, Makinohara (JP)

(73) Assignee: Yazaki Corporation, Minato-ku, Tokyo (JP)

( * ) Notice: Subject to any disclaimer, the term of this patent is extended or adjusted under 35 U.S.C. 154(b) by 0 days.

(21) Appl. No.: 14/609,666

(22) Filed: Jan. 30, 2015

(65) Prior Publication Data

US 2015/0140873 A1 May 21, 2015

Related U.S. Application Data

(63) Continuation of application No. PCT/JP2013/070640, filed on Jul. 30, 2013.

(30) Foreign Application Priority Data

Jul. 30, 2012 (JP) ..... 2012-168153

(51) Int. Cl.
*H01R 4/20* (2006.01)
*H01R 4/18* (2006.01)
*H01R 4/62* (2006.01)

(52) U.S. Cl.
CPC ..... *H01R 4/20* (2013.01); *H01R 4/185* (2013.01); *H01R 4/187* (2013.01); *H01R 4/62* (2013.01)

(58) Field of Classification Search
CPC ..... H01R 4/20; H01R 4/187; H01R 13/5221; H01R 4/1873
See application file for complete search history.

(56) References Cited

U.S. PATENT DOCUMENTS 2,379,567 A * 7/1945 Buchanan ..... H01R 4/206 439/868
2,758,491 A * 8/1956 Buchanan ..... H01R 43/058 29/753
2,815,497 A * 12/1957 Redslob ..... H01R 4/62 174/90

(Continued)

FOREIGN PATENT DOCUMENTS

CN 1591979 A 3/2005
CN 102576949 A 7/2012

(Continued)

OTHER PUBLICATIONS

Feb. 3, 2015—International Preliminary Report on Patentability—Intl App PCT/JP2013/070640.

(Continued)

*Primary Examiner* — Briggitte R Hammond
(74) *Attorney, Agent, or Firm* — Banner & Witcoff, Ltd.

(57) ABSTRACT

A sheath (4) of an aluminum electric wire (1) is peeled, a distal end of an exposed conductor part (2) is tightened and connected after being placed in a conductor crimping part (13) of a crimped terminal (10) while being recessed to be further inside than the distal end of the conductor crimping part (13), and the distal end section of the conductor crimping part (13) of the crimped terminal (10) which forms an empty space where there is not the conductor part is welded and sealed.

6 Claims, 8 Drawing Sheets

(56) References Cited

U.S. PATENT DOCUMENTS

| | | | | |
|---|---|---|---|---|
| 2,868,863 | A * | 1/1959 | Cook | H01R 4/62 174/84 C |
| 3,955,044 | A | 5/1976 | Hoffman et al. | |
| 5,951,308 | A * | 9/1999 | Rea | H01R 13/18 439/125 |
| 6,334,798 | B1 * | 1/2002 | Ushijima | H01R 4/187 439/203 |
| 7,048,562 | B2 | 5/2006 | Lutsch et al. | |
| 7,174,633 | B2 * | 2/2007 | Onuma | H01R 4/04 29/854 |
| 7,699,670 | B1 * | 4/2010 | Jacques | H01R 13/111 439/842 |
| 8,000,803 | B2 * | 8/2011 | Araujo | A61N 1/3752 439/877 |
| 8,641,461 | B2 * | 2/2014 | Mitose | H01R 4/185 439/587 |
| 2002/0034898 | A1 * | 3/2002 | Kuwayama | H01R 4/185 439/877 |
| 2005/0026515 | A1 | 2/2005 | Hashimoto et al. | |
| 2006/0014412 | A1 | 1/2006 | Lutsch et al. | |
| 2006/0292922 | A1 * | 12/2006 | Froschl | H01R 4/023 439/442 |
| 2010/0035487 | A1 * | 2/2010 | Nakagawa | H01R 4/184 439/877 |
| 2011/0070770 | A1 | 3/2011 | Sakai | |
| 2011/0070781 | A1 * | 3/2011 | Kitagawa | H01R 4/185 439/877 |
| 2011/0225820 | A1 * | 9/2011 | Kondo | H01R 4/185 29/863 |
| 2012/0214360 | A1 * | 8/2012 | Kumakura | H01R 4/04 439/878 |
| 2012/0324727 | A1 * | 12/2012 | Seifert | H01R 4/187 29/867 |
| 2014/0144016 | A1 | 5/2014 | Bauer et al. | |
| 2014/0335745 | A1 * | 11/2014 | Kawamura | H01R 4/206 439/878 |

FOREIGN PATENT DOCUMENTS

| | | | |
|---|---|---|---|
| JP | 64-009361 | U | 1/1989 |
| JP | H01-132068 | A | 5/1989 |
| JP | H06-6470 | Y | 2/1994 |
| JP | 2004-071437 | A | 3/2004 |
| JP | 2006-032312 | A | 2/2006 |
| JP | 2009-176537 | A | 8/2009 |
| JP | 2010-049941 | A | 3/2010 |
| JP | 2010-225529 | A | 10/2010 |
| JP | 2011-243329 | A | 12/2011 |
| WO | 2012-025235 | A1 | 3/2012 |

OTHER PUBLICATIONS

Feb. 9, 2016—(JP) Decision of Refusal—App 2012-168153—Eng Tran.

May 26, 2016—(CN) First Office Action—App 20130040830.0—Eng Tran.

Office Action issued Nov. 2, 2016 for counterpart Chinese application 20130040830.0 (and English language translation of Office Action).

Oct. 29, 2013—International Search Report—App PCT/JP2013/070640—English Translation.

Dec. 1, 2015 (JP) Office Action in App. 2012-168153.

* cited by examiner

CRIMPED TERMINAL ATTACHED ALUMINUM ELECTRIC WIRE

CROSS REFERENCE TO RELATED APPLICATIONS

This application is a continuation of PCT application No. PCT/JP2013/070640, which was filed on Jul. 30, 2013 based on Japanese Patent Application (No. 2012-168153) filed on Jul. 30, 2012, the contents of which are incorporated herein by reference.

BACKGROUND OF THE INVENTION

1. Field of the Invention

The present invention relates to a crimped terminal attached aluminum electric wire. In the present specification, both an electric wire made of aluminum and an electric wire made of aluminum alloy are named an aluminum electric wire.

2. Description of the Related Art

Typically, copper electric wires are used for wire harnesses that are wired in a vehicle such as an automobile. When these wire harnesses are connected or the wire harness and an in-vehicle apparatus are connected, a terminal is attached to the copper electric wire of the wire harness, and this kind of terminal is typically attached to the copper electric wire by being crimped.

Typically, the terminal, which is crimped to the copper electric wire, includes a bottom plate on which a conductor part of the copper electric wire which is formed by twisting a plurality of copper strands is placed, and a pair of conductor tightening pieces which are provided adjacently to the bottom plate to hold the conductor part which is placed on the bottom plate. When the pair of conductor tightening pieces are crimped inward, the conductor part of the copper electric wire is sandwiched between the bottom plate and the pair of conductor tightening pieces so that the terminal is crimped to the conductor part of the copper electric wire by this sandwiching.

In recent years, in consideration of the lightweighting of vehicles, and the easiness of material recycling, in addition to the lack of copper resource, it is considered to use aluminum electric wires to replace the copper electric wires. However, an oxide film formed on the surface of aluminum is thicker than that of copper, and for the aluminum electric wire, the contact resistance between the conductor part and the crimped terminal tends to become relatively higher.

Thus, to reduce the contact resistance between the conductor part of the aluminum electric wire and the crimped terminal, a method is adopted to strongly crimp a barrel (conductor crimping part) of the crimped terminal to the conductor part of the aluminum electric wire to raise compression rate of the conductor part of the aluminum electric wire. When this method is used, because the conductor part of the aluminum electric wire is strongly crimped, the oxide film of the strands of the conductor part of the aluminum electric wire is broken and the contact resistance between the conductor part and the crimped terminal of the aluminum electric wire is reduced.

It is known that when water exists at the contact part (crimped part) where different kinds of metals (that is, the aluminum material and the copper material) contact, the two metals (aluminum and copper) dissolve into the water as ions, a potential difference between the aluminum material and the copper material is produced, and electrolytic corrosion occurs.

Thus, when the crimped terminal made of copper or copper alloy is connected to the conductor part of the aluminum electric wire, the crimped part of the conductor part of the aluminum electric wire crimped by the barrel of the crimped terminal is crimped at a high compression rate so that water is prevented from invading the contact portion where the conductor part of the aluminum electric wire and the barrel of the crimped terminal contact, and the occurrence of the electrolytic corrosion can be avoided.

However, part of the core line of the conductor part of the aluminum electric wire, which is axially before and after the barrel of the crimped terminal crimped by the barrel of the crimped terminal in the axial direction, contacts the crimped terminal in an exposed state, and when water attaches to this part, the contact portion of the conductor part of the aluminum electric wire and the barrel of the crimped terminal becomes immersed in electrolytic solution, and the electrolytic corrosion which is that metal aluminum whose ionization tendency is high dissolves might advance.

Thus, a crimping structure is proposed in which the conductor part of the aluminum electric wire and a crimped terminal made by copper or copper alloy are connected, and water is prevented from invading the contact portion of the conductor part and the crimped terminal.

In a terminal metal fitting attached electric wire disclosed in a patent document 1, the front ends of conductor tightening pieces of a conductor crimping part in the crimped terminal are provided with bent portions to control the distal end section of the conductor of the electric wire which projects to the front side of the conductor crimping part from jumping up while the conductor tightening pieces are tightened, and anticorrosion material is coated in a range from the conductor exposed at the front side of the conductor crimping part on this bent portions via a joint of the conductor tightening pieces to a joint of coating tightening pieces.

Patent document 1: JP-A-2011-243329

SUMMARY OF THE INVENTION

According to the crimping structure disclosed in the patent document 1, the front ends of conductor tightening pieces of a conductor crimping part in the crimped terminal are provided with bent portions to control the distal end section of the conductor of the electric wire, which projects to the front side of the conductor crimping part, from jumping up while the conductor tightening pieces are tightened, and anticorrosion material is coated in a range from the conductor exposed at the front side of the conductor crimping part on this bent portions via the joint of the conductor tightening pieces to the joint of the coating tightening pieces.

Anticorrosion grease, UV cured resin or the like is used for the anticorrosion material, and the anticorrosion material is applied with a brush, or is applied by making resin discharged by using nozzles. There is a problem which is that the anticorrosion grease, the UV cured resin or the like deteriorates over time when exposed to external air for a long term, and water may not be sufficiently prevented from invading the contact portion of the conductor part of the aluminum electric wire and the barrel of the crimped terminal.

The present invention is made in view of the above described circumstances, and the present invention is intended to provide a crimped terminal attached aluminum electric wire for which water can be prevented for a long term from invading the crimping part of the conductor part of the aluminum electric wire and the barrel of a crimped terminal made of copper or copper alloy, a good conducting state between the conductor part of the aluminum electric wire and the crimped terminal can be kept, and electrolytic corrosion at the contact portion of the conductor part of the aluminum electric wire axially before and after the barrel of the crimped terminal and the barrel of the crimped terminal can be prevented from occurring.

(1) In a crimped terminal attached aluminum electric wire, an insulator of an aluminum electric wire having a conductor covered by the insulator and formed by twisting a plurality of strands made of aluminum or aluminum alloy is peeled, a distal end of an exposed conductor part is tightened and connected after being placed in a conductor crimping part of a crimped terminal made of copper or copper ally while being recessed to be further inside than the distal end of the conductor crimping part, and the distal end section of the conductor crimping part of the crimped terminal which forms an empty space where there is not the conductor part is welded and sealed.

(2) In a crimped terminal attached aluminum electric wire, tongues which project to a distal end of the conductor crimping part is formed on a pair of conductor tightening pieces at a distal end of a conductor crimping part of a crimped terminal made of copper or copper alloy, an insulator of an aluminum electric wire having a conductor covered by the insulator and formed by twisting a plurality of strands made of aluminum or aluminum alloy is peeled, a distal end of an exposed conductor part is tightened and connected after being placed in the conductor crimping part of the crimped terminal so as not to protrude from the distal end of the conductor crimping part, the distal end section, where the conductor part is received, of the conductor crimping part is covered by the tongues, and the distal end section of the conductor crimping part is sealed by welding the tongues.

(3) In the crimped terminal attached aluminum electric wire according to the configurations (1) or (2), a joint of the pair of conductor tightening pieces in the conductor crimping part of the crimped terminal is welded and sealed.

According to the crimped terminal attached aluminum electric wire described in the above (1), because the distal end section of the conductor crimping part of the crimped terminal is welded and is sealed, water can be prevented for a long term from invading the contact portion of the conductor part of the aluminum electric wire at the axial front end of the conductor crimping part of the crimped terminal and the conductor crimping part of the crimped terminal.

According to the crimped terminal attached aluminum electric wire described in the above (2), because the distal end section, where the conductor part is received, of the conductor crimping part of the crimped terminal is covered by the tongues which are provided to project from the distal end of the conductor crimping part, and the tongues are welded and sealed, water can be prevented for a long term from invading the contact portion of the conductor part of the aluminum electric wire at the axial front end of the conductor crimping part of the crimped terminal and the conductor crimping part of the crimped terminal.

According to the crimped terminal attached aluminum electric wire described in the above (3), because the joint of the pair of conductor tightening pieces in the conductor crimping part of the crimped terminal is welded and is sealed, water can be more strongly prevented from invading from the joint of the pair of conductor tightening pieces in the conductor crimping part of the crimped terminal.

The crimped terminal attached aluminum electric wire described in (1) to (3) can be applied to not only an opened barrel but also a closed barrel.

The present invention has been briefly described above. Further, details of the present invention will become more apparent after embodiments of the invention described below (hereinafter referred to as "embodiments") are read with reference to the accompanying figures.

DETAILED DESCRIPTION OF THE EXEMPLARY EMBODIMENTS

Below, particular embodiments of the crimped terminal attached aluminum electric wire according to the present invention are described in detail based on the figures.

Embodiment 1

The embodiment 1 of the crimped terminal attached aluminum electric wire according to the present invention is shown in FIGS. 1 to 6.

Figure 1:
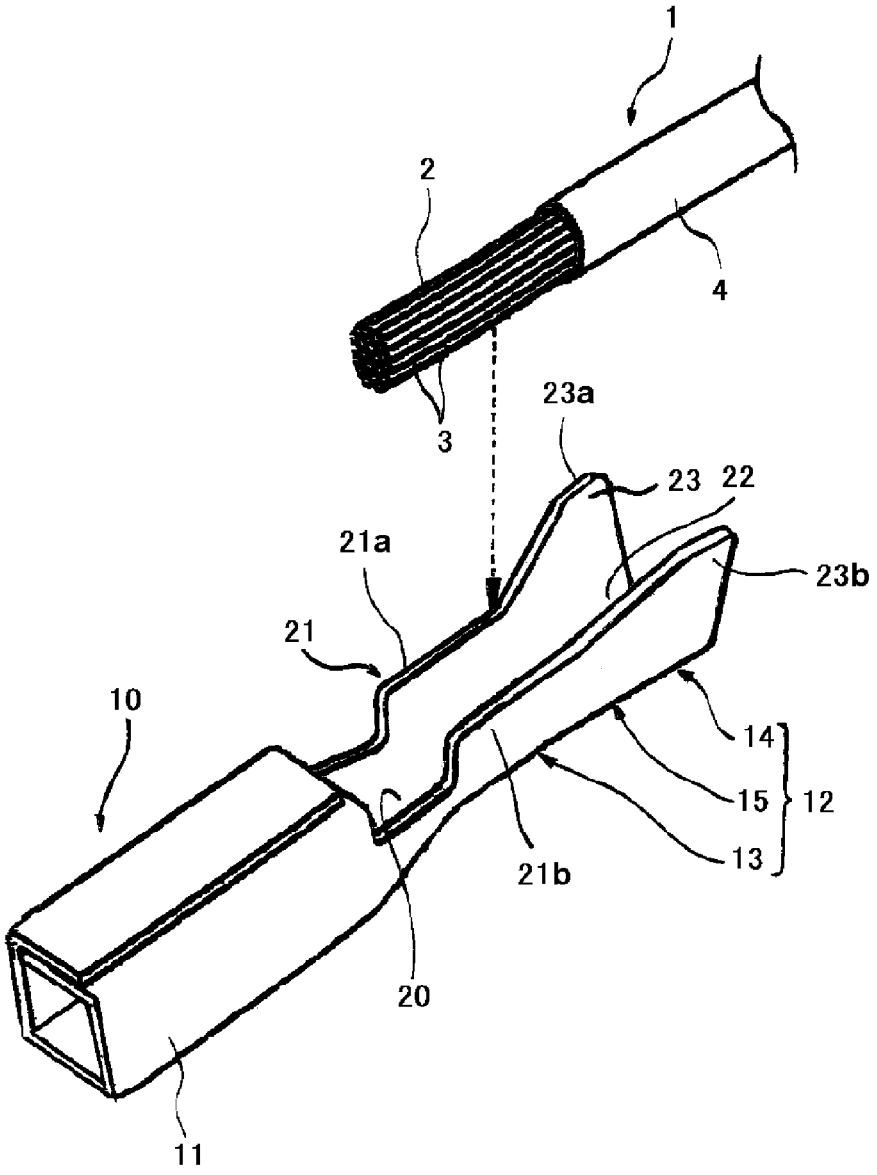
FIG. 1 is an exploded perspective view which shows a crimped terminal attached aluminum electric wire according to an embodiment 1 of the present invention.

As shown in FIG. 1, an aluminum electric wire 1 is constructed by a coated electric wire which has a conductor part 2 which is formed by twisting a plurality of strands 3 made of aluminum or aluminum alloy, and a sheath (insulator) 4 which is formed of an insulating material and circumferentially coats the conductor part 2.

For example, the aluminum alloy, which the aluminum electric wire 1 is formed of, may be an alloy of aluminum and iron. In comparison with a conductor made of aluminum, the conductor made of this alloy is easier to spread and has a higher strength (particularly pulling strength).

As shown in FIG. 1, a crimped terminal 10 is formed by press-molding (including bending) a board material made of conductive metal such as copper alloy.

The distal end of the crimped terminal 10 is provided with a terminal connecting part 11 which is connected with a mating terminal (not illustrated), and the base end of the crimped terminal 10 is provided with an electric wire holding part 12 which holds the aluminum electric wire 1.

The electric wire holding part 12 includes a conductor crimping part 13, which holds the distal end section of the conductor part 2 of the aluminum electric wire 1, at the distal end side and a sheath holding part 14, which holds the sheath 4 of the aluminum electric wire 1, at the base end side.

A common bottom plate is formed continuously from a bottom plate 20 of the conductor crimping part 13 to a bottom plate 22 of the sheath holding part 14. Furthermore, between conductor tightening pieces 21 of the conductor crimping part 13 and sheath tightening pieces 23 of the sheath holding part 14, as walls that connect the conductor tightening pieces 21 and the sheath tightening pieces 23, a pair of covering walls 15 is provided which deform plastically to cover the space between the conductor crimping part 13 and the sheath holding part 14 with the tightening of the conductor tightening pieces 21 and the sheath tightening pieces 23.

The conductor crimping part 13 includes the bottom plate 20 and the pair of conductor tightening pieces 21 which include a conductor tightening piece 21*a* and a conductor tightening piece 21*b*. The conductor crimping part 13 is molded into a roughly U shape in a section perpendicular to the longitudinal direction of the crimped terminal 10, and on the bottom plate 20, the conductor part 2 of the aluminum electric wire 1 is placed.

The sheath holding part 14 includes the bottom plate 22 and the pair of the sheath tightening pieces 23 which include a sheath tightening piece 23*a* and a sheath tightening piece 23*b*. The sheath holding part 14 is molded into a roughly U shape in a section perpendicular to the longitudinal direction of the crimped terminal 10, and on the bottom plate 22, a part of the aluminum electric wire 1 at the end which is covered by the sheath 4 is placed.

The conductor crimping part 13 is formed of the bottom plate 20 and the pair of conductor tightening pieces 21*a*, 21*b* which stand up from two (left and right) side edges of the bottom plate 20 to extend upward. The pair of conductor tightening pieces 21*a*, 21*b* are bent inward to enclose the conductor part 2 of the aluminum electric wire 1 which should be connected, and the conductor part 2 of the aluminum electric wire 1 is tightened to be adhered onto the top surface of the bottom plate 20. With the tightening, a joint 26 of the pair of conductor tightening pieces 21 in the conductor crimping part 13 of the crimped terminal 10 is produced (refer to FIG. 4).

When the pair of conductor tightening pieces 21*a*, 21*b* are respectively bent inward to enclose the conductor part 2 of the aluminum electric wire 1, after distal ends 21*c*, 21*d* of the pair of conductor tightening pieces 21*a*, 21*b* positionally approach toward the bottom plate 20 while the outer surfaces of the pair of conductor tightening pieces 21*a*, 21*b* rub each other and are joined together, the conductor tightening pieces 21*a*, 21*b* are bent toward the lower side in the alignment direction (horizontal direction) to cut into the conductor part 2 of the aluminum electric wire 1.

Figure 2:
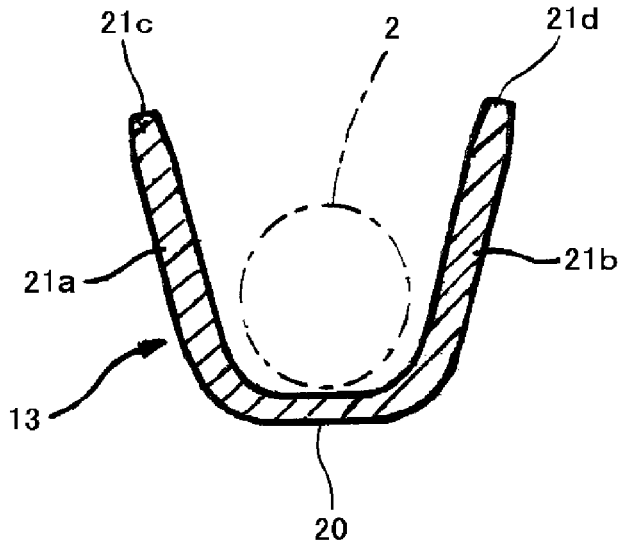
FIG. 2 is a cross-sectional view which shows that a conductor part, which is exposed when the insulator of the aluminum electric wire shown in FIG. 1 is peeled, is placed on a conductor crimping part of the crimped terminal.

The conductor crimping part 13 of the crimped terminal 10 is formed to be longer than the conductor part 2 of the aluminum electric wire 1 which is placed on the conductor crimping part 13. Therefore, when the conductor part 2 of the aluminum electric wire 1 is placed on the pair of conductor tightening pieces 21 as shown in FIG. 2, and the conductor part 2 of the aluminum electric wire 1 is tightened by the conductor crimping part 13 of the crimped terminal 10 with the pair of conductor tightening pieces 21 as shown in FIG. 3, the distal end of the conductor part 2 of the aluminum electric wire 1 becomes recessed at an invisible back position from the distal end section of the conductor crimping part 13 of the crimped terminal 10 as shown in FIG. 4.

Figure 5:
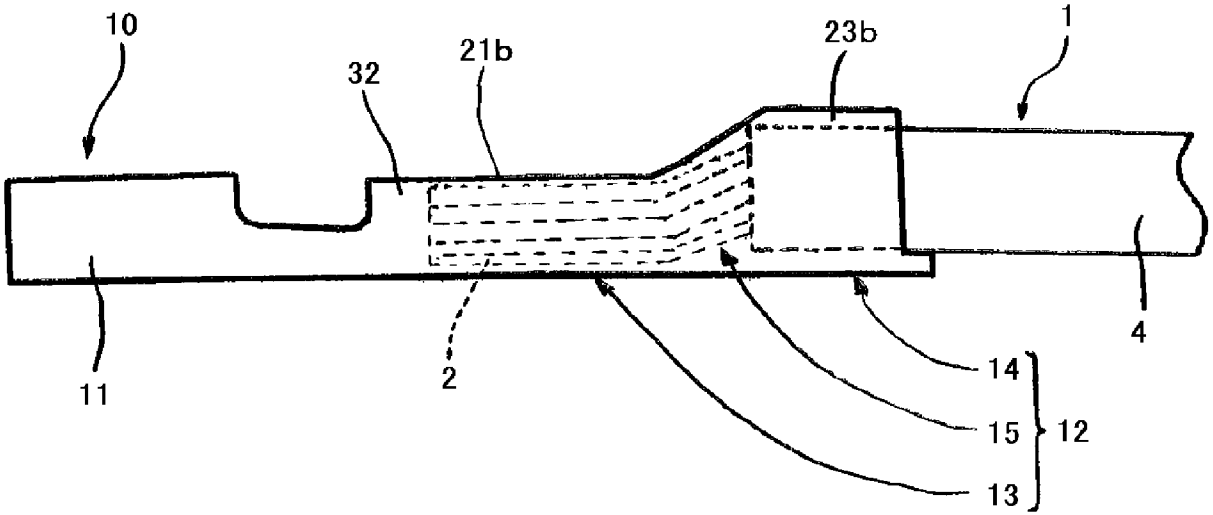
FIG. 5 is a side view of the crimped terminal attached aluminum electric wire shown in FIG. 4.

That is, as shown in FIG. 5, the conductor part 2 of the aluminum electric wire 1 becomes received in the conductor crimping part 13 of the crimped terminal 10, and the distal end section of the conductor crimping part 13 of the crimped terminal 10 forms an empty space where there is not the conductor part 2. Therefore, the distal end of the conductor part 2 of the aluminum electric wire 1 is located at a position further inside than the distal end section of the conductor crimping part 13 in the crimped terminal 10.

Figure 3:
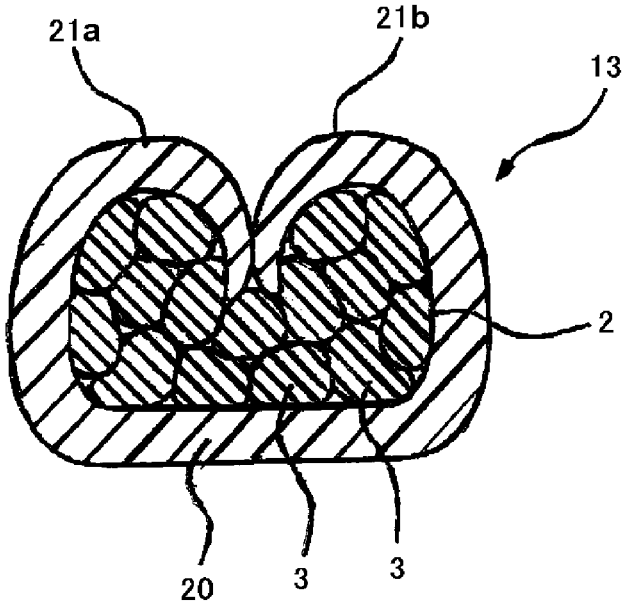
FIG. 3 is a cross-sectional view which shows that the conductor part of the aluminum electric wire, which is placed on the conductor crimping part of the crimped terminal shown in FIG. 2, is tightened with a pair of conductor tightening pieces.
Figure 4:
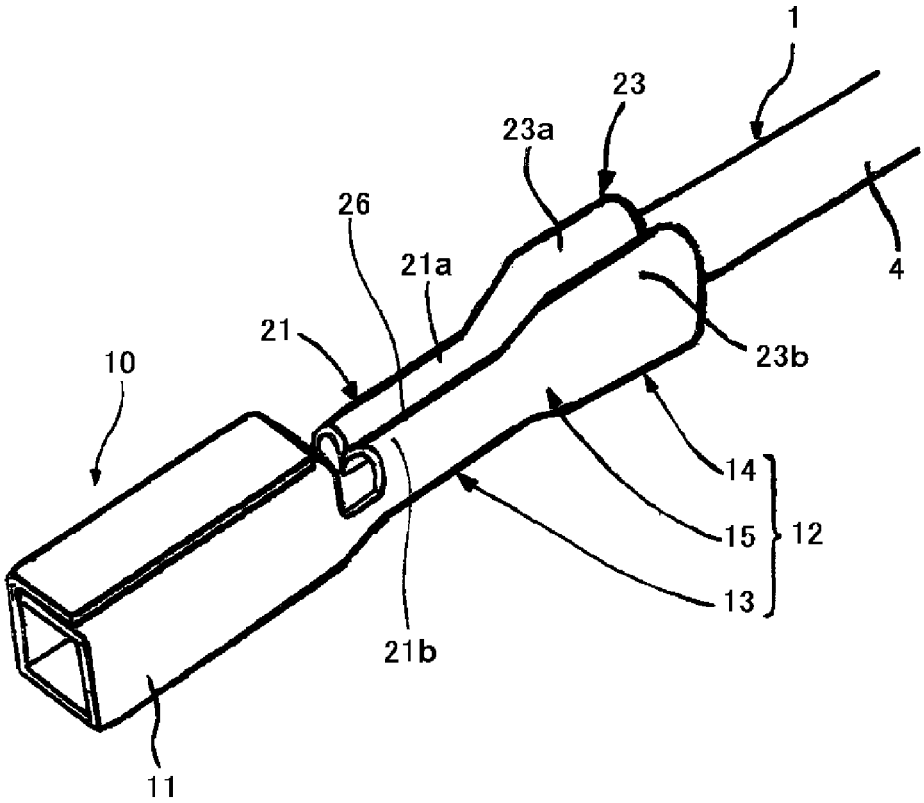
FIG. 4 is a perspective diagram of the crimped terminal attached aluminum electric wire which is tightened with the pair of conductor tightening pieces in the conductor crimping part of the crimped terminal shown in FIG. 3.
Figure 6:
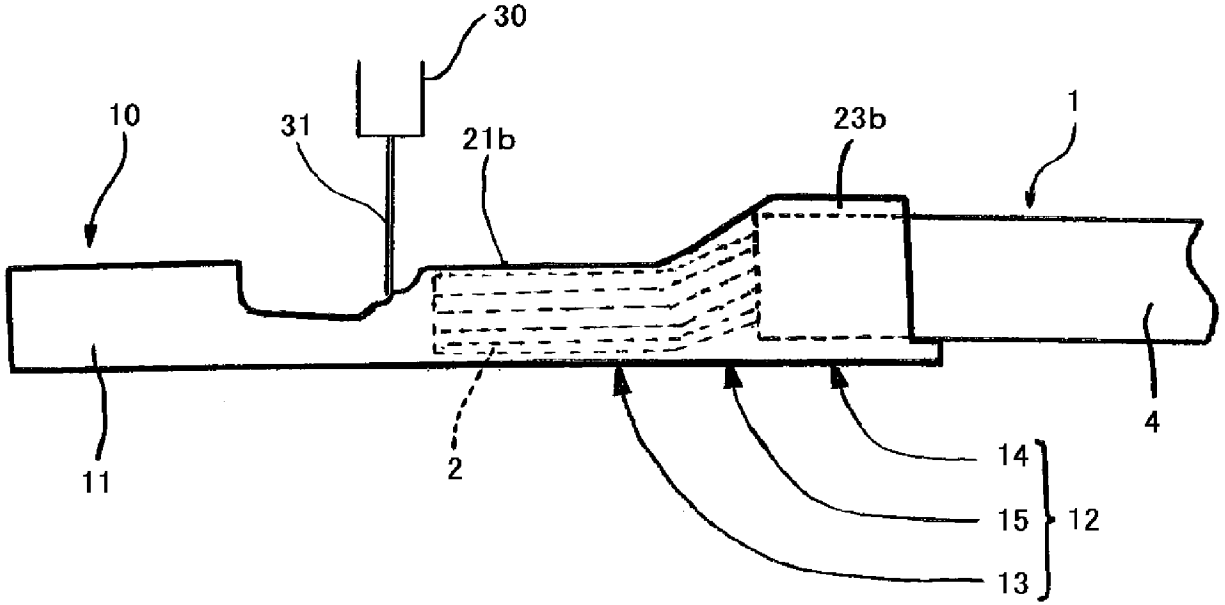
FIG. 6 is a side view of the crimped terminal attached aluminum electric wire which is welded and sealed after a laser beam is irradiated to the distal end section in the conductor crimping part of the crimped terminal of the crimped terminal attached aluminum electric wire shown in FIG. 5.

As shown in FIG. 3, after the conductor crimping part 13 of the crimped terminal 10 is tightened to the conductor part 2 of the aluminum electric wire 1 with the pair of conductor tightening pieces 21, as shown in FIG. 6, a laser beam 31 is irradiated by a laser welding device 30 to the distal end section, where there is not the conductor part 2 of the aluminum electric wire 1, of the conductor crimping part 13 in the crimped terminal 10. When the laser beam 31 is irradiated by the laser welding device 30, an edge 32 (refer to FIG. 5) of the conductor crimping part 13 of the crimped terminal 10 is melted, the melted edge 32 of the conductor crimping part 13 blocks up a distal end opening of the conductor crimping part 13 in the crimped terminal 10, and is welded to the bottom plate 20 of the conductor crimping part 13, and the distal end opening of the conductor crimping part 13 is sealed.

After the conductor part 2 of the aluminum electric wire 1 is placed on the bottom plate 20 of the crimped terminal 10 as thus constructed, and a part of the sheath 4 of the aluminum electric wire 1 is placed on the bottom plate 22 of the crimped terminal 10, by tightening the pair of conductor tightening pieces 21, the pair of covering walls 15 and the pair of the sheath tightening pieces 23, the conductor part 2 of the aluminum electric wire 1 becomes enclosed in the pair of conductor tightening pieces 21 and adhered to the conductor crimping part 13. The part from the conductor part 2 to the sheath 4 of the aluminum electric wire 1 is enclosed in the pair of covering walls 15, and the part of the sheath 4 of the aluminum electric wire 1 is enclosed in the pair of the sheath tightening pieces 23 and becomes adhered to the sheath holding part 14.

Thus, since the part tightened by the pair of conductor tightening pieces 21 of the crimped terminal 10 is strongly adhered by the crimping force of the pair of conductor tightening pieces 21, water will not enter.

On the other hand, the distal end opening of the conductor crimping part 13 of the crimped terminal 10 is sealed, since the laser beam 31 is irradiated by the laser welding device 30 and the edge 32 of the conductor crimping part 13 in the crimped terminal 10 is welded to the bottom plate 20 of the conductor crimping part 13. Therefore, water will not enter the inside of the conductor part 2 of the aluminum electric wire 1 from the distal end of the conductor crimping part 13 of the crimped terminal 10.

Herein, the laser welding device 30 is used to weld the distal end opening of the conductor crimping part 13 in the crimped terminal 10, but a resistance welding device also may be used.

Thus, according to the present embodiment 1, a good conducting state is kept at the crimping part where the conductor part 2 of the aluminum electric wire 1 is crimped by the conductor crimping part 13 of the crimped terminal 10 made of copper or copper alloy, and water can be prevented for a long term from invading from the axial front end of the conductor crimping part 13 of the crimped terminal 10 into the inside of the conductor crimping part 13 of the crimped terminal 10.

Further, according to the present embodiment 1, because it is not necessary to coat anticorrosion material, electrolytic corrosion can be prevented at a low cost.

Embodiment 2

Figure 7:
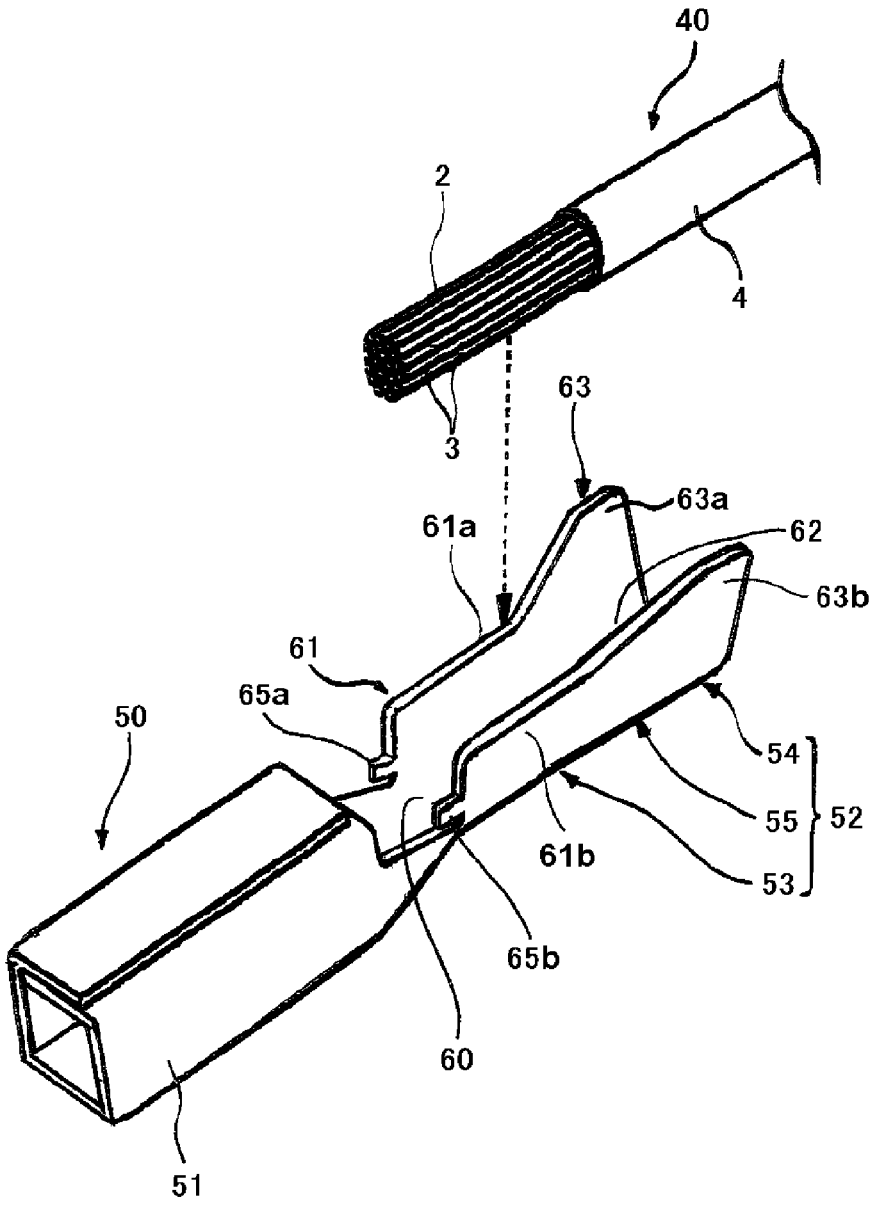
FIG. 7 is an exploded perspective view which shows a crimped terminal attached aluminum electric wire according to an embodiment 2 of the present invention.
Figure 8:
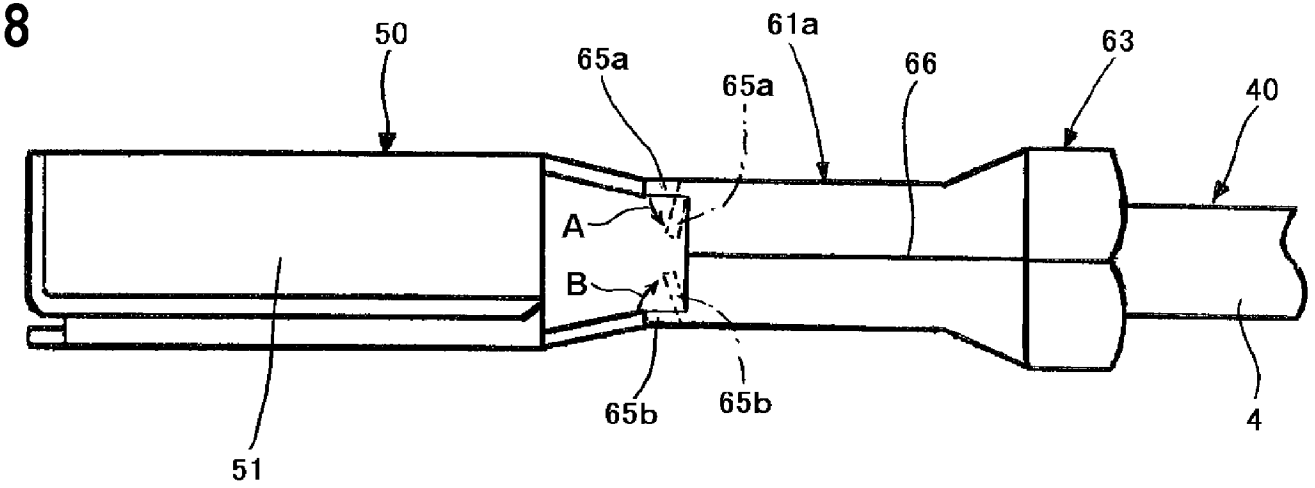
FIG. 8 is a top view of the crimped terminal attached aluminum electric wire shown in FIG. 7.

The embodiment 2 of the crimped terminal attached aluminum electric wire according to the present invention is shown in FIGS. 7 to 8.

The embodiment 2 shown in FIG. 7 is different from the embodiment 1 shown in FIG. 1 in the next point. That is, in the embodiment 1 shown in FIG. 1, the sheath 4 of the aluminum electric wire 1, in which the conductor part 2 which is formed by twisting a plurality of strands 3 made of aluminum or aluminum alloy is covered by the sheath 4, is peeled, the distal end of the exposed conductor part 2 is tightened and connected after being placed in the conductor crimping part 13 of the crimped terminal 10 made of copper or copper ally while being recessed to be further inside than the distal end of the conductor crimping part 13, and the distal end section of the conductor crimping part 13 in the crimped terminal 10 which forms an empty space where there is not the conductor part 2 is welded and sealed.

In contrast, in the embodiment 2 shown in FIG. 7, a pair of conductor tightening pieces 61 at the distal end of a conductor crimping part 53 of a crimped terminal 50 made of copper or copper alloy are respectively provided with tongues 65*a*, 65*b*, which project from the distal end of the conductor crimping part 53, the sheath 4 is peeled, the distal end of the exposed conductor part 2 is tightened and connected after being placed in the conductor crimping part 53 of the crimped terminal 50 not to protrude from the distal end of the conductor crimping part 53, the distal end section, where the conductor part 2 is received, of the conductor crimping part 53 of the crimped terminal 50 is covered by the tongues 65*a*, 65*b*, and the distal end section of the conductor crimping part 53 of the crimped terminal 50 is sealed when the tongues 65*a*, 65*b* are welded.

In FIG. 7, an aluminum electric wire 40 has the same construction as that of the aluminum electric wire 1 shown in FIG. 1, and at one end part of the aluminum electric wire 40 (distal end section of the electric wire), a predetermined length of the sheath 4 is removed to expose the conductor part 2.

As shown in FIG. 7, the crimped terminal 50 is formed by press-molding (including bending) a board material made of conductive metal such as copper alloy. The distal end of the crimped terminal 50 is provided with a terminal connecting part 51 which is connected with a mating terminal (not illustrated), and the base end of the crimped terminal 50 is provided with an electric wire holding part 52 which holds the aluminum electric wire 40.

The electric wire holding part 52 includes the conductor crimping part 53, which holds the distal end section of the conductor part 2 of the aluminum electric wire 40, at the distal end side and a sheath holding part 54, which holds the sheath 4 of the aluminum electric wire 40, at the base end side.

A common bottom plate is formed continuously from a bottom plate 60 of the conductor crimping part 53 to a bottom plate 62 of the sheath holding part 54. Furthermore, between conductor tightening pieces 61 of the conductor crimping part 53 and sheath tightening pieces 63 of the sheath holding part 54, as walls that connect the conductor tightening pieces 61 and the sheath tightening pieces 63, a pair of covering walls 55 is provided which deform plastically to cover the space between the conductor crimping part 53 and the sheath holding part 54 with the tightening of the conductor tightening pieces 61 and the sheath tightening pieces 63.

The conductor crimping part 53 includes the bottom plate 60 and the pair of conductor tightening pieces 61 which include a conductor tightening piece 61*a* and a conductor tightening piece 61*b*. The conductor crimping part 53 is molded into a roughly U shape in a section perpendicular to the longitudinal direction of the crimped terminal 50, and on the bottom plate 60, the conductor part 2 of the aluminum electric wire 40 is placed.

The sheath holding part 54 includes the bottom plate 62 and the pair of the sheath tightening pieces 63 which include a sheath tightening piece 63*a* and a sheath tightening piece 63*b*. The sheath holding part 54 is molded into a roughly U shape in a section perpendicular to the longitudinal direction of the crimped terminal 50, and on the bottom plate 62, a part of the aluminum electric wire 40 at the end which is covered by the sheath 4 is placed.

The pair of conductor tightening pieces 61 at the distal end of the conductor crimping part 53 of the crimped terminal 50 made of copper or copper alloy are respectively provided with the tongues 65*a*, 65*b*, which project from the distal end of the conductor crimping part 53. The tongues 65*a*, 65*b* are provided to follow the conductor tightening pieces 61*a*, 61*b*. The tongues 65*a*, 65*b* have such a size that a distal end opening of the conductor crimping part 53 of the crimped terminal 50 which is formed by the conductor tightening pieces 61*a*, 61*b* can be blocked up when the tongues 65*a*, 65*b* are bent inward.

On the bottom plate 60 of the crimped terminal 50 as thus constructed, the distal end of the conductor part 2, for which the sheath 4 of the aluminum electric wire 40 is peeled, is place in the conductor crimping part 53 of the crimped terminal 50 not to project from the distal end of the conductor crimping part 53, and on the bottom plate 62 of the crimped terminal 50*d*, a part of the sheath 4 of the aluminum electric wire 40 is placed. Thereafter, the pair of conductor tightening pieces 61, the pair of covering walls 55 and the pair of sheath tightening pieces 63 are tightened. With the tightening, a joint 66 of the pair of conductor tightening pieces 61 in the conductor crimping part 53 of the crimped terminal 50 is produced (refer to FIG. 8).

In this way, for the aluminum electric wire 40 and the crimped terminal 50, as shown in FIG. 8, the conductor part 2 of the aluminum electric wire 40 is enclosed in the pair of conductor tightening pieces 61 and is adhered to the conductor crimping part 53. The part from the conductor part 2 to the sheath 4 of the aluminum electric wire 40 is enclosed in the pair of covering walls 55, and the part of the sheath 4 of the aluminum electric wire 40 is enclosed in the pair of the sheath tightening pieces 63 and becomes adhered to the sheath holding part 54.

Thus, when the pair of conductor tightening pieces 61, the pair of covering walls 55 and the pair of sheath tightening pieces 63 are tightened as shown in FIG. 8, the tongue 65*a* is bent toward the inside of the conductor tightening pieces 61 of the crimped terminal 50 as shown with the arrow A in FIG. 8. Like the tongue 65*a*, the tongue 65*b* is bent toward the inside of the conductor tightening pieces 61 of the crimped terminal 50 as shown with the arrow B in FIG. 8 so that the distal end section, where the conductor part 2 is received, of the conductor crimping part 53 of the crimped terminal 50 is covered by the tongues 65*a*, 65*b*.

Thereafter, like in FIG. 6, the laser beam 31 is irradiated to the tongue 65*a* and the tongue 65*b* by the laser welding device 30, the tongues 65*a*, 65*b* are melted to block up the distal end opening of the conductor crimping part 53 in the crimped terminal 50, and the distal end opening of the conductor crimping part 53 is sealed. Therefore, water will not enter the inside of the conductor part 2 of the aluminum electric wire 40 from the distal end section of the conductor crimping part 53 of the crimped terminal 50.

Thus, according to the present embodiment 2, a good conducting state is kept at the crimping part where the conductor part 2 of the aluminum electric wire 40 is crimped by the conductor crimping part 53 of the crimped terminal 50 made of copper or copper alloy, and water can be prevented for a long term from invading from the axial front end of the conductor crimping part 53 of the crimped terminal 50 into the inside of the conductor crimping part 53 of the crimped terminal 50.

Further, according to the present embodiment 2, because it is not necessary to coat anticorrosion material, electrolytic corrosion can be prevented at a low cost.

Embodiment 3

Figure 9:
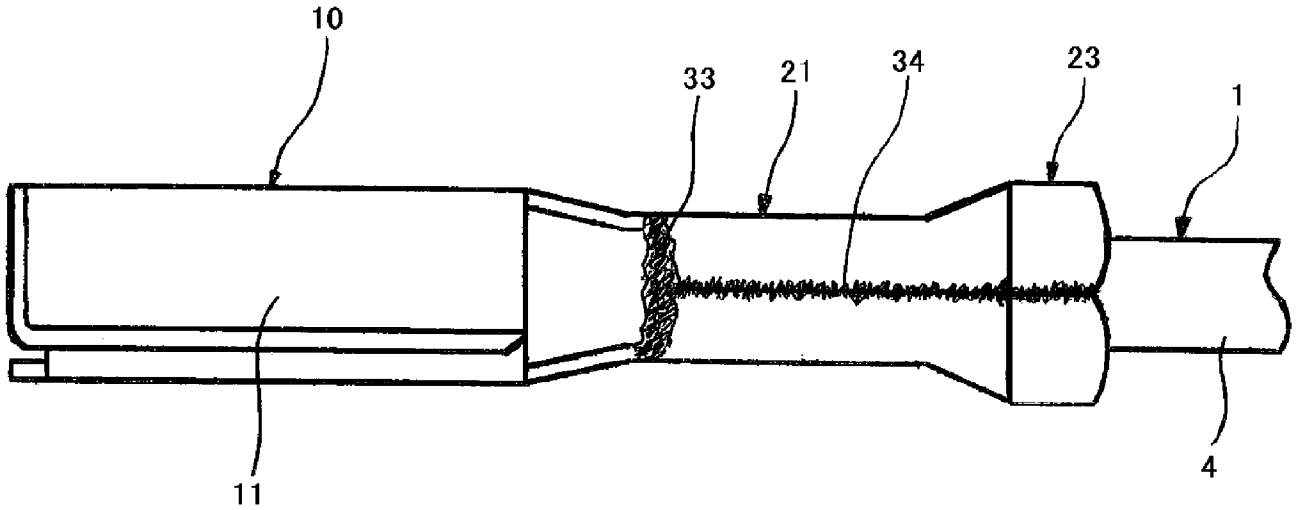
FIG. 9 is a top view of a crimped terminal attached aluminum electric wire according to an embodiment 3 of the present invention.

The embodiment 3 of the crimped terminal attached aluminum electric wire according to the present invention is shown in FIG. 9.

The key points of the invention according to the embodiment 3 shown in FIG. 9 are that the joint 26 of the pair of conductor tightening pieces 21 of the conductor crimping part 13 of the crimped terminal 10 of the crimped terminal attached aluminum electric wire according to the embodiment shown in FIG. 1 is sealed by being welded, and the joint 66 of the pair of conductor tightening pieces 61 of the conductor crimping part 53 of the crimped terminal 50 of the crimped terminal attached aluminum electric wire according to the embodiment shown in FIG. 8 is sealed by being welded.

In FIG. 9, the laser beam 31 is irradiated by the laser welding device 30 to the joint 26 of the pair of conductor tightening pieces 21 in the conductor crimping part 13 of the crimped terminal 10 of the crimped terminal attached aluminum electric wire according to the embodiment 1 shown in FIG. 1, and the joint 26 is welded.

That is, in FIG. 9, the laser beam 31 is irradiated by the laser welding device 30 to the distal end section, where there is not the conductor part 2 of the aluminum electric wire 1, in the conductor crimping part 13 of the crimped terminal 10, the edge 32 in the conductor crimping part 13 of the crimped terminal 10 is melted, and a welded part 33 is formed.

Further, in FIG. 9, when the pair of conductor tightening pieces 21, the pair of covering walls 15 and the pair of the sheath tightening pieces 23 are tightened, the joint 26 of the pair of conductor tightening pieces 21 in the conductor crimping part 13 of the crimped terminal 10 is produced, the laser beam 31 is irradiated by the laser welding device 30 to the joint 26, the joint 26 in the conductor crimping part 13 of the crimped terminal 10 is melted, and a welded part 34 is formed.

Thus, when the laser beam 31 is irradiated to the joint 26 by the laser welding device 30, the joint 26 of the pair of conductor tightening pieces 21*a*, 21*b* in the conductor crimping part 13 of the crimped terminal 10 is melted, and the welded part 34 is formed, water can be more strongly prevented from invading from the joint 26 of the pair of conductor tightening pieces 21*a*, 21*b* in the conductor crimping part 13 of the crimped terminal 10.

In either of the embodiment 1 shown in FIG. 1, the embodiment 2 shown in FIG. 7, and the embodiment 3 shown in FIG. 9, it is described that the crimped terminal is an opened barrel-shaped one, but it is needless to say that the present invention is also applicable to a closed barrel-shaped one.

Here, the features of the crimped terminal attached aluminum electric wires according to the embodiments of present invention described above are briefly, collectively listed as follows, respectively.

[1] A crimped terminal attached aluminum electric wire comprising an aluminum electric wire 1 and a crimped terminal 10, wherein an insulator (sheath) 4 of the aluminum electric wire 1, which has a conductor part 2 which is formed by twisting a plurality of strands 3 made of aluminum or aluminum alloy and is covered by the insulator (sheath) 4, is peeled, the distal end of the exposed conductor part 2 is tightened and connected after being placed in a conductor crimping part 13 of the crimped terminal 10 made of copper or copper ally while being recessed to be further inside than the distal end of the conductor crimping part 13, and the distal end section of the conductor crimping part 13 in the crimped terminal 10 which forms an empty space where there is not the conductor part 2 is welded and sealed.

[2] A crimped terminal attached aluminum electric wire comprising an aluminum electric wire 40 and a crimped terminal 50, wherein a pair of conductor tightening pieces 61 at the distal end of a conductor crimping part 53 of the crimped terminal 50 made of copper or copper alloy are respectively provided with tongues 65*a*, 65*b*, which project from the distal end of the conductor crimping part 53, an insulator (sheath) 4 of the aluminum electric wire 40, which has a conductor part 2 which is formed by twisting a plurality of strands 3 made of aluminum or aluminum alloy and is covered by the insulator (sheath) 4, is peeled, the distal end of the exposed conductor part 2 is tightened and connected after being placed in the conductor crimping part 53 of the crimped terminal 50 not to protrude from the distal end of the conductor crimping part 53, the distal end section, where the conductor part 2 is received, of the conductor crimping part 53 is covered by the tongues 65*a*, 65*b*, and the distal end section of the conductor crimping part 53 is sealed when the tongues 65*a*, 65*b* are welded.

[3] The crimped terminal attached aluminum electric wire according to the above [1] or [2], the joint of the pair of conductor tightening pieces 21*a*, 21*b* or 61*a*, 61*b* in the conductor crimping part 13 or 53 of the crimped terminal 10 or 50 is welded and sealed.

The invention accomplished by the inventor is described in detail based on the above embodiments of the invention, but the present invention is not limited to the above embodiments of the invention and can be modified in various ways without departing from the spirit of the invention.

According to the crimped terminal attached aluminum electric wire of the present invention, a crimped terminal attached aluminum electric wire can be provided for which water can be prevented for a long term from invading the crimping part of the conductor part of the aluminum electric wire and the barrel of a crimped terminal made of copper or copper alloy, a good conducting state between the conductor part of the aluminum electric wire and the crimped terminal can be kept, and electrolytic corrosion at the contact portion of the conductor part of the aluminum electric wire axially before and after the barrel of the crimped terminal and the barrel of the crimped terminal can be prevented from occurring.

What is claimed is:

1. An assembly of a crimped terminal and an aluminum electric wire, the assembly comprising:

an aluminum wire including an insulator and a conductor covered by the insulator and formed by twisting a plurality of strands made of aluminum or aluminum alloy, the insulator being peeled at a distal end of the aluminum wire; and a crimped terminal that includes a conductor crimping part and is made of copper or copper alloy, wherein the distal end of the aluminum wire is tightened and connected to the conductor crimping part after being placed in the conductor crimping part while being recessed to be further inside than a distal end of the conductor crimping part, and wherein the distal end of the conductor crimping part of the crimped terminal which forms an empty space where there is not the conductor of the aluminum wire is welded and sealed by a portion of the conductor crimping part that is melted when the distal end is welded.

2. An assembly of a crimped terminal and an aluminum electric wire, the assembly comprising:

a crimped terminal that includes a conductor crimping part and is made of copper or copper alloy, a pair of conductor tightening pieces being formed at a distal end of the conductor crimping part, and tongues projecting from a distal end side of the conductor tightening pieces, an aluminum electric wire that includes an insulator and a conductor covered by the insulator and formed by twisting a plurality of strands made of aluminum or aluminum alloy, the insulator being peeled at a distal end of the aluminum wire, wherein the distal end of the aluminum electric wire is tightened and connected to the conductor crimping part after being placed in the conductor crimping part so as not to protrude from the distal end of the conductor crimping part, and wherein the distal end section, where the conductor of the aluminum electric wire is received, of the conductor crimping part is covered by the tongues, and the distal end section of the conductor crimping part is sealed by welding the tongues.

3. The assembly according to claim 1, wherein the conductor crimping part includes a pair of conductor tightening pieces, and wherein a joint of the pair of conductor tightening pieces in the conductor crimping part of the crimped terminal is welded and sealed.

4. The assembly according to claim 2, wherein a joint of the pair of conductor tightening pieces in the conductor crimping part of the crimped terminal is welded and sealed.

5. An assembly of a crimped terminal and an aluminum electric wire, the assembly comprising:

an aluminum wire including an insulator and a conductor covered by the insulator and formed by twisting a plurality of strands made of aluminum or aluminum alloy, the insulator being peeled at a distal end of the aluminum wire; and a crimped terminal that includes a conductor crimping part and is made of copper or copper alloy, wherein the distal end of the aluminum wire is tightened and connected to the conductor crimping part after being placed in the conductor crimping part while being recessed to be further inside than a distal end of the conductor crimping part, and wherein the distal end of the conductor crimping part of the crimped terminal which forms an empty space where there is not the conductor of the aluminum wire is welded and sealed, wherein the conductor crimping part includes:

a bottom plate; and a pair of conductor tightening pieces.

6. The assembly according to claim 2, wherein the conductor crimping part includes:

a bottom plate; and a pair of conductor tightening pieces.

* * * * *